US006527191B1

(12) United States Patent
Jannersten

(10) Patent No.: US 6,527,191 B1
(45) Date of Patent: Mar. 4, 2003

(54) PLAYING CARDS PROVIDED WITH A MACHINE-READABLE CODE

(75) Inventor: Per Jannersten, Uppsala (SE)

(73) Assignee: Jannersten Förlag AB, Avesta (SE)

( * ) Notice: Subject to any disclaimer, the term of this patent is extended or adjusted under 35 U.S.C. 154(b) by 0 days.

(21) Appl. No.: 09/540,617

(22) Filed: Mar. 31, 2000

(30) Foreign Application Priority Data

Apr. 1, 1999 (SE) ..... 9901196

(51) Int. Cl.[7] ..... G06K 19/00

(52) U.S. Cl. ..... 235/487; 235/462.01; 235/462.08; 235/494; 273/151; 273/293; 273/304

(58) Field of Search ..... 235/487, 494, 235/462.01, 462.08; 273/151, 293, 304, 305, 306

(56) References Cited

U.S. PATENT DOCUMENTS 2,168,047 A * 8/1939 Skellett ..... 178/19
3,152,256 A * 10/1964 Zuck et al. ..... 250/209
3,654,434 A * 4/1972 Forman et al. ..... 235/61.11
3,947,666 A * 3/1976 Carlson ..... 235/61.11
3,983,364 A * 9/1976 Firehammer et al. ..... 235/61.6
4,605,846 A * 8/1986 Duret et al. ..... 235/468
5,110,134 A * 5/1992 Laughlin et al. ..... 273/293
5,259,907 A * 11/1993 Soules et al. ..... 156/277
5,312,104 A * 5/1994 Miller ..... 273/148
5,331,141 A * 7/1994 Kaneko ..... 235/462

* cited by examiner

*Primary Examiner*—Michael G. Lee
*Assistant Examiner*—Seung Ho Lee
(74) *Attorney, Agent, or Firm*—Alfred J. Mangels

(57) ABSTRACT

Playing cards that include a machine-readable bar code in the form of a number of mutually parallel and juxtaposed bars, wherein the code is adapted to be read by light sensitive detectors. Each playing card includes at least one six-position binary code in which a bar is either present or absent at each of the six positions. The code includes a reference code in the form of an additional bar in at least one further position adjacent to the six-position binary code. The reference code is positioned for detection by a light sensitive detector. The binary code is intended to be read by means of the light sensitive detectors when the existence of the reference code is detected.

12 Claims, 2 Drawing Sheets

PLAYING CARDS PROVIDED WITH A MACHINE-READABLE CODE

BACKGROUND OF THE INVENTION

1. Field of the Invention

The present invention relates to playing cards that are provided with a machine-readable code. Such cards are used in connection with bridge, for instance.

2. Description of the Related Art

In certain situations there is a need to monitor card distribution. For instance, casinos need to be able to register events taking place at the gaming tables, in order to reduce the risk of fraud. In the case of bridge competitions, it is normal to duplicate card distributions, i.e. the hands dealt, so as to enable all players to play the same hands. By solely comparing the players that have played the same cards, the risk that the competition will be concerned only with the best cards that are dealt is eliminated.

It is known to provide playing cards with a machine-readable code to this end, so as to enable the various cards to be distinguished from each other and mutually identified. Also known to the art are devices that register cards taken from a pack and dealt to a player, as are also devices which divide a pack into four predetermined hands and the cards scanned mechanically and divided into four piles on the basis of the scan.

In order to widen the use of encoded playing cards there is required a simple code on the one hand and simple and inexpensive card reading devices on the other hand.

A known encoding technique involves providing the cards with a number of light dots and dark dots which lie along a line on a card, and using a reader in the form of an array of light-sensitive elements to detect the dark and light regions, respectively, as the card passes the reader. The code is fed perpendicularly to its longitudinal extension, in over the array of elements, said array extending parallel with the longitudinal extension of the code. Although this encoding and reading technique is inexpensive, it has the serious drawback that the reader, which is fixedly mounted, is unable to read a code that is displaced laterally relative to the reader as the code is advanced. This displacement, or offset, may be due to the code having been placed in the wrong position on the cards, or may be due to mechanical deficiencies in the feed mechanism by means of which the cards are mechanically discharged or sorted.

Another encoding system is one in which the cards are provided with an EAN bar code. An BAN code is normally scanned by a code reader that includes a plurality of laser beams. Although the code is read reliably, irrespective of whether it is stationary Or moves relative to the reader, the reading equipment is so expensive as to prevent its general use in the present context.

EAN codes are based on a plurality of parallel bars of different thicknesses. One inexpensive method of reading such a code, is to pass the code over a dot reader perpendicularly to the longitudinal extension of the bar code. One condition in this respect, however, is that the code is advanced past the reader at a constant speed. This is difficult to achieve. In the case of mechanical card feeders, the speed at which the cards pass the reader is liable to vary and therewith result in the code being read incorrectly. In the case of certain known card dispensing devices, the cards are withdrawn manually from a container and variations in speed are so high that known reading techniques are unable to function satisfactorily.

In summary, it can be said that there is no technique of reading a code on a playing card that moves relative to a reader in a direction where variations in the location of the code on the cards or variations in the rate at which the cards are read can be accepted.

This problem is solved by the present invention, which provides a code that can be easily read with great reliability by means of inexpensive equipment.

SUMMARY OF THE INVENTION

Accordingly, the present invention relates to playing cards that are provided with a machine-readable bar code in the form of a plurality of mutually parallel and juxtaposed bars that are intended to be scanned by means of light sensitive detectors. Each playing card is provided with at least a six-position binary code where a bar is either present of absent at each position. The code is expanded with a reference code in the form of a bar in at least one further position on one side of said binary code. The reference code is detected by a light sensitive detector, and said binary code is scanned by said light sensitive detectors when the reference code is detected.

BRIEF DESCRIPTION OF THE DRAWINGS

The invention will now be described in more detail partly with reference to an exemplifying embodiment thereof illustrated in the accompanying drawings, in which.

DESCRIPTION OF THE PREFERRED EMBODIMENTS

Figure 1:
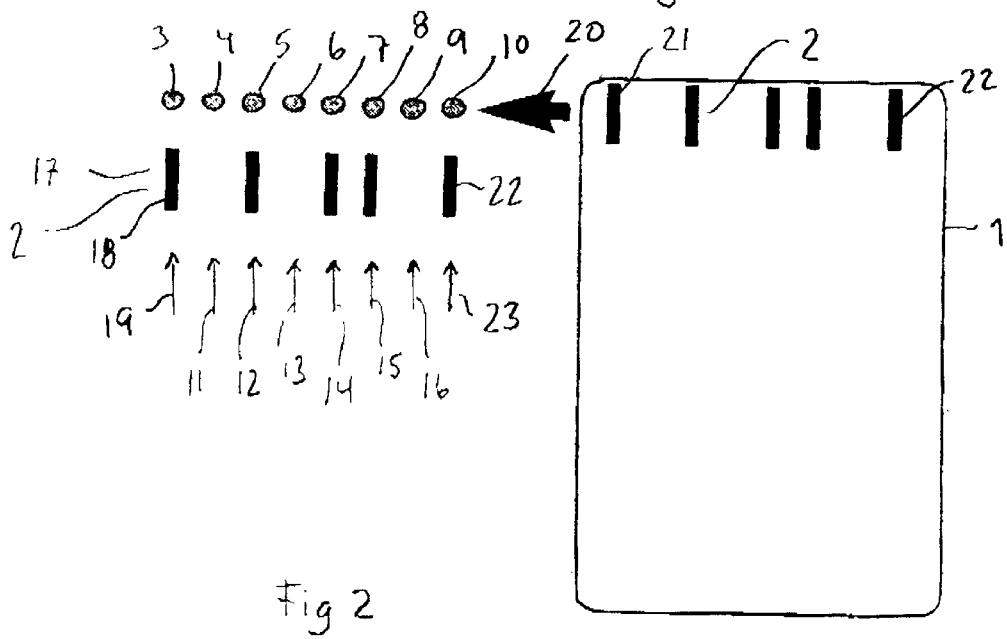
FIG. 1 is a schematic illustration of a reader and a code-bearing playing card.

The present invention relates to playing cards 1 that are provided with a machine-readable bar code 2 in the form of a number of mutually parallel and juxtaposed bars, as shown in FIG. 1. The code is intended to be read by light sensitive detectors 3–10.

The light sensitive detectors 3–10 are suitably of a known kind, such as phototransistors, and are fixed relative to one another in a detector array.

The playing cards 1 are of a conventional kind on which the code is printed by a typical printing, process. The code will preferably be printed on a light colored part of the cards, such as to consist of dark bars separated by light parts.

However, the code may consist of white bars against a darker background.

Alternatively, the bars may consist of a color that is not visible to the human eye but which, nevertheless, can be detected by the light sensitive detectors. For instance, there can be used a color which fluoresces when irradiated with ultraviolet light, this color being invisible when irradiated with visible light. In this respect, the reader will, of course, include a light source that emits ultraviolet light. Other optical, detectable, colors that are invisible to the eye can be used, for instance colors that reflect infrared light. This embodiment has the advantage of preventing the code being seen by a player. Furthermore, the playing cards will all have the same appearance to the eye as non-coded playing cards.

The invention is thus not restricted to any particular embodiment with respect to colors with which the code is printed, although the invention will be described hereinafter with reference to an exemplifying embodiment in which the code and the reference code are comprised of dark bars on a lighter background.

According to the invention, each playing card 1 is provided with at least one six-position binary code 2, where a bar is either present or absent at each position. FIG. 1 shows the positions in respect of the six-position binary code 17 with the arrows 11–16.

According to the invention, each code 2, 17 is expanded with a reference code in the form of a dark bar 18 in at least one further position 19 by the side of the code 17.

In accordance with the invention, the reference code 18 is intended for detection by a light sensitive detector 3, wherewith the binary code 17 is intended to be read by the light sensitive detectors 4–9 upon detection of the reference code 18.

A code 2, 17 is read in the following way. A card is passed mechanically or manually from a first position in a card container of a suitably known kind to a second position. The card is caused to move from the first to the second position in a manner such that the different positions of the code 2, 17 will be located over the fixed array of detectors 3–9 simultaneously. When the detector 3 indicates the presence of the reference code 18, the code positions 11–16 are read immediately by the detectors 4–9.

Reading of the code by the detectors 4–9 with respect to the presence or the absence of a bar in respective positions results in an electrical signal that is delivered to and processed in a microprocessor or some corresponding device. The microprocessor is adapted to interpret the reading result with respect to which card, i.e. color and value, has been read.

The use of a reference code triggers reading of the remainder of the code. This means that reading of the code is independent of speed, since the entire code is read instantaneously. Furthermore, extremely simple and inexpensive light sensitive elements can be used to this end. Because a binary code of only six positions is sufficient to identity every card in a pack, where each bar can be made relatively wide and where all bars have the same width, the code can be printed on the cards in a simple and inexpensive manner with relatively low precision requirements with respect to reliable reading of the code. It will be obvious from FIG. 1, that the playing card can be moved in over the array of elements in the direction shown by the arrow 20, wherein the code is first read when the bar 21 in code 2 has reached the position 19 and is than read by the detector 3 that is intended to read the reference code.

However, the playing card may equally as well be passed in over the reader-array in a direction from above and downwards in FIG. 1, the code bars therewith being moved in their longitudinal direction over respective detectors. The code will thus also be read in this case when the detector 3 detects the bar 21. One drawback with moving the card in this direction, however, is that the code must not be displaced laterally, i.e. in a direction to the right or to the left in FIG. 1, relative to the array of detectors as the card is moved from above and downwards.

According to one highly preferred embodiment of the invention, the reference code includes a further bar 22, wherewith the binary code will be embraced by a total of two reference bars 18, 22 each in its respective position. The further reference code 22 is placed in a position 23 and is intended to be read by a detector 10 in said position, in a manner corresponding to the manner in which the reference code 18 is read by detector 3.

Figure 2:
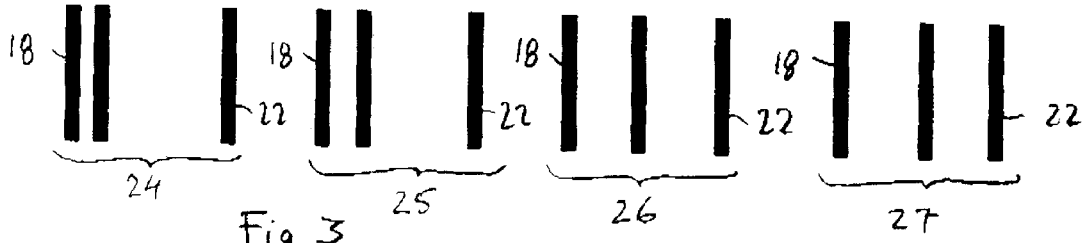
FIG. 2 illustrates one embodiment of the invention.
Figure 3:
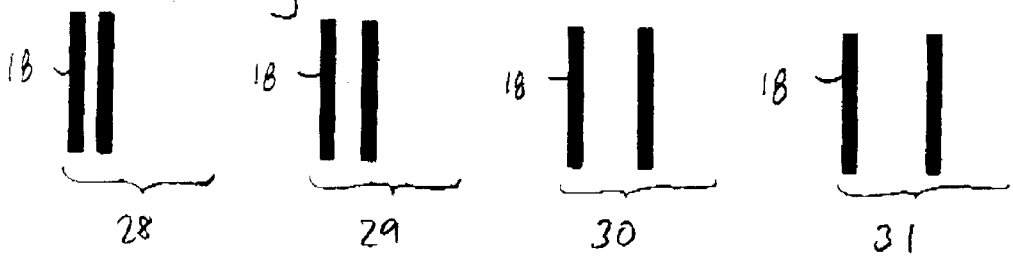
FIG. 3 illustrates another embodiment of the invention.

FIG. 2 illustrates four codes 24–27, each of which includes two reference codes 18, 22. FIG. 3 shows four codes 28–31 with the same form of binary codes as the codes shown in FIG. 1, but with only one reference code 18 being included.

In respect of the FIG. 2 embodiment, it is necessary for both reference codes 18, 22 to be read simultaneously by the detectors 3, 10 in order for the binary code to be read. This affords two advantages. One advantage is that the playing card can be moved in over the array from either the left or the right in FIG. 1. The code will be read correctly in either case. The other advantage is that the card cannot be read when it is passed obliquely in relation to, the array to an extent that only one of the reference codes is read by the detectors.

According to one preferred embodiment, the code 2 is placed at the top or bottom edge of the card 1, where the code is intended to be read by moving the card over the light sensitive detectors 3–10 in its own plane and in a direction 20 perpendicular to the longitudinal extension of the bars. This embodiment enables the length and width of the bars to be limited without danger of a jeopardizing reading of the code.

According to one preferred embodiment, the length of respective bars in relation to the length of the code is such that each position 19–23 of the code 2 including the reference code will lie within the detection range of respective light sensitive detectors in the event of maximum rotation of the playing card in its own plane during movement of the card. By maximum rotation is meant the maximum rotation permitted by the device in which the cards are placed.

Figure 4:
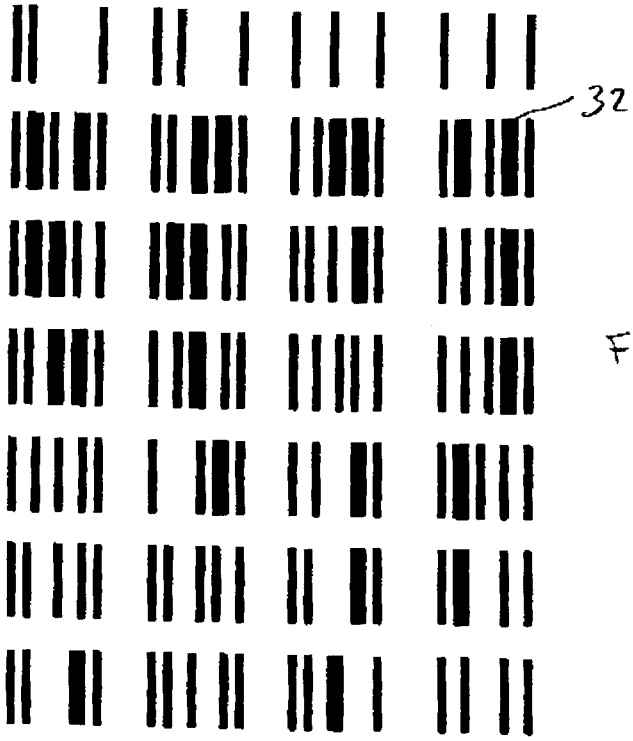
FIGS. 4 and 5 are examples of 55 different codes for 55 different cards.
Figure 5:
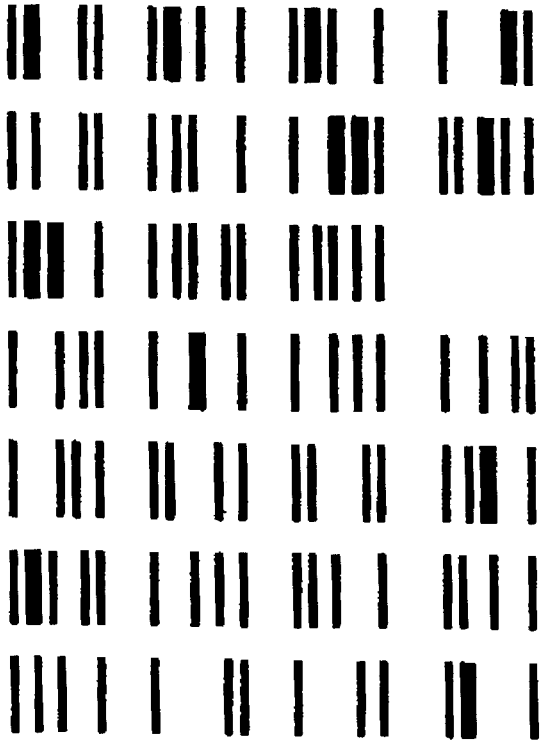

According to one embodiment, two mutually adjacent bars in the binary code may be combined to form a single broad bar 32. Examples of such bars are shown in FIGS. 4 and 5. The fact that the present invention allows such an embodiment without jeopardizing code reading reliability reduces the precision in which the printing process need by carried out.

FIGS. 4 and 5 each show four columns and seven rows of mutually different binary six-position codes. These codes exemplify how the codes can be formed in respect of a pack of playing cards.

It will be obvious that the present invention solves the problems mentioned in the introduction. The present invention enables a playing card to be readily encoded without requiring any great precision in this respect, and also enables such cards to be read with the aid of a simple and inexpensive reader.

Although reference has been made to two reference codes in respect of the aforedescribed embodiments, it will be understood that more reference codes may be used, for instance a further reference code may be placed adjacent the bars 18, 22, or in some other way. Furthermore, although only one six-position binary code has been mentioned, it will be understood that the binary code can be extended if necessary to a seven-position code, an eight-position code, and so on, if necessary. It will also be understood that the position of the code on respective playing cards may be varied.

Consequently, the present invention shall not be considered to be limited to the aforedescribed embodiments thereof, since variations can be made within the scope of the accompanying Claims.

What is claimed is:

1. Playing cards that include a machine-readable bar code defined by a number of mutually parallel and juxtaposed bars, wherein the code is adapted to be read by a plurality of light sensitive detectors, said playing cards comprising: at least one six-position binary bar code where a bar is either present or absent at each position; a reference bar in at least one position adjacent said binary bar code for detection by a light sensitive detector; wherein the binary code and reference bar are read by respective individual light sensitive detectors that correspond in number with the number of bar code positions and with the number of reference bars, wherein each of the light sensitive detectors simultaneously senses the presence or absence of a bar at an associated bar position when the presence of a reference bar is detected as the card is transported in its own plane and over said light sensitive detectors in a direction substantially perpendicular to a longitudinal extension of the bars.

2. Playing cards according to claim 1, wherein the reference code includes two bars each placed adjacent a respective end position of the six-position bar code.

3. Playing cards according to claim 1, wherein the six-position bar code is located at one of a top edge and a bottom edge of respective cards.

4. Playing cards according to claim 1, wherein two mutually adjacent bars in the six-position bar code are combined to form a single broad bar.

5. Playing cards according to claim 1, wherein the bars are dark against a light background.

6. Playing cards according to claim 1, wherein the bars are invisible to the eye but are detectable by the bar detectors.

7. Playing cards according to claim 1, wherein the bars are light against a dark background.

8. Playing cards according to claim 1, wherein the bars are defined by a color that fluoresces under ultraviolet light and that is not visible to the eye under visible light.

9. Playing cards according to claim 1, wherein the bars are defined by a color that reflects infrared light and that is not visible to the eye under visible light.

10. Playing cards according to claim 1, wherein the six-position bar code is defined by bars having substantially the same width.

11. Playing cards according to claim 10, wherein the reference code has substantially the same width as that of the bars of the six-position bar code.

12. Playing cards that include a machine-readable bar code defined by a number of mutually parallel and juxtaposed bars, wherein the code is adapted to be read by a plurality of light sensitive detectors, said playing cards comprising: at least one six-position binary bar code where a bar is either present or absent at each position; a reference bar in at least one position adjacent said binary bar code for detection by a light sensitive detector; wherein the binary code and reference bar are read by respective individual light sensitive detectors that correspond in number with the number of bar code positions and with the number of reference bars, wherein each of the light sensitive detectors simultaneously senses the presence or absence of a bar at an associated bar position when the presence of a reference bar is detected as the card is transported in its own plane and over said light sensitive detectors in a direction substantially perpendicular to a longitudinal extension of the bars, wherein a ratio of bar length to playing card length is such that with rotation of a card in its own plane through a predetermined angle of rotation during transportation of the card, each position of the six-position bar code and the reference code lies in a bar detecting range of a respective light sensitive bar detector, and wherein the six-position bar code is defined by bars having substantially the same width.

* * * * *